US005107774A

United States Patent [19]

Allen

[11] Patent Number: 5,107,774

[45] Date of Patent: Apr. 28, 1992

[54] VARIABLE SLANT BOARD

[76] Inventor: Donald L. Allen, 1445 Allen Dr., Eureka, Calif. 95501

[21] Appl. No.: 581,877

[22] Filed: Sep. 13, 1990

[51] Int. Cl.[5] ..... A47F 5/12

[52] U.S. Cl. ..... 108/7; 108/2

[58] Field of Search ..... 108/7, 6, 9, 2, 1, 3; 240/454, 284, 160

[56] References Cited

U.S. PATENT DOCUMENTS

| | | | |
|---|---|---|---|
| 1,029,420 | 6/1912 | Buzby | 248/284 X |
| 1,956,546 | 4/1934 | Froelich | 108/7 X |
| 3,826,204 | 7/1974 | Kuhlmann et al. | 108/2 |
| 3,874,309 | 4/1975 | Cowley | 108/2 |
| 3,903,812 | 9/1975 | Cowley | 108/2 |
| 4,351,245 | 9/1982 | Laporte | 108/2 X |
| 4,397,245 | 8/1983 | Washburn | 108/7 |
| 4,781,126 | 11/1988 | Lochridge | 108/6 |
| 4,791,873 | 12/1988 | Towfigh | 108/10 |

FOREIGN PATENT DOCUMENTS

| | | | |
|---|---|---|---|
| 96023 | 5/1963 | Denmark | 108/49 |
| 520297 | 6/1931 | Fed. Rep. of Germany | 248/454 |

*Primary Examiner*—Jose V. Chen
*Attorney, Agent, or Firm*—Henderson & Sturm

[57] ABSTRACT

A variable slant work board pivotally mounted to a base such as a table or desk. A winch actuated segmented arm supplies an upward force on the underside of the work board to pivot it upwardly toward the fully raised vertical position. A horizontally disposed expansion spring is attached by cable to the underside of the work board to bias it toward the fully lowered horizontal position. The work board is infinitely adjustable between the vertical and horizontal positions.

5 Claims, 3 Drawing Sheets

VARIABLE SLANT BOARD

TECHNICAL FIELD

This invention relates to a work surface, and more particularly to a work surface that is angularly adjustable between a horizontal position and a vertical position.

BACKGROUND ART

The need for angular adjustment of a work surface to enhance the productivity and comfort of the user has long been recognized. Elaborate structures for such angular adjustments have been provided. However, the adjustment has either been in a relatively narrow range or the adjustment has been limited to a few discrete angles. The adjustments provided are considered inadequate by users due to lack of flexibility.

A further problem encountered in powered variable slant boards is that of bulkiness. The power drive mechanisms are typically located such that they interfere with the functionality of the associated work area.

Those concerned with these and other problems recognize the need for an improved variable slant board.

DISCLOSURE OF THE INVENTION

The present invention provides a variable slant work board pivotally mounted to a base such as a table or desk. A winch actuated segmented arm supplies an upward force on the underside of the work board to pivot it upwardly toward the fully raised vertical position. A horizontally disposed expansion spring is attached by cable to the underside of the work board to bias it toward the fully lowered horizontal position. The work board is infinitely adjustable between the vertical and horizontal positions.

An object of the present invention is the provision of an improved variable slant board.

Another object is to provide a variable slant board that has a low profile for mounting in an associated work area.

A further object of the invention is the provision of a variable slant board that has infinite angular adjustment from horizontal to vertical.

Still another object is to provide a variable slant board that is easy and convenient to use.

A still further object of the present invention is the provision of a variable slant board that is adaptable for use with a variety of base units.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
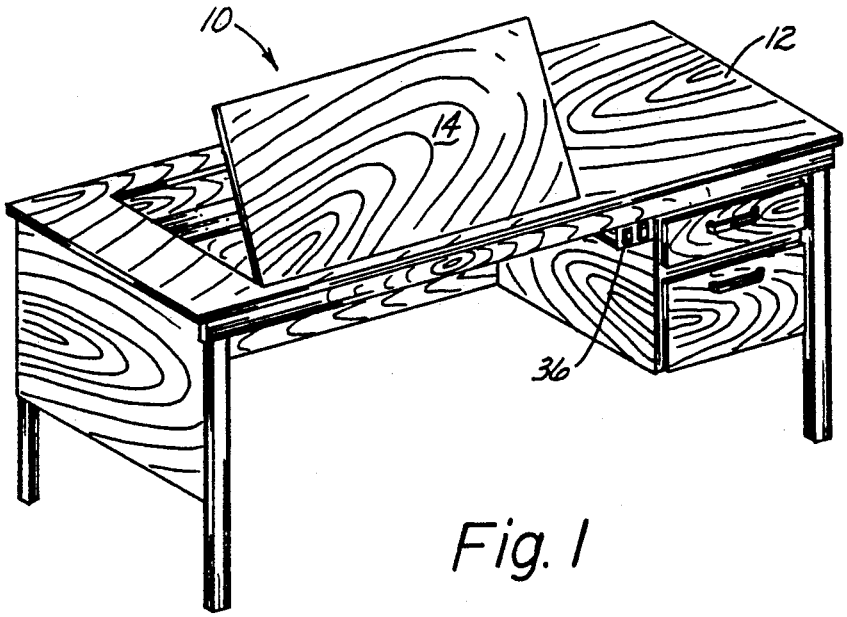
FIG. 1 is a perspective view of the variable slant work board of the present invention incorporated into a conventional desk.
Figure 2:
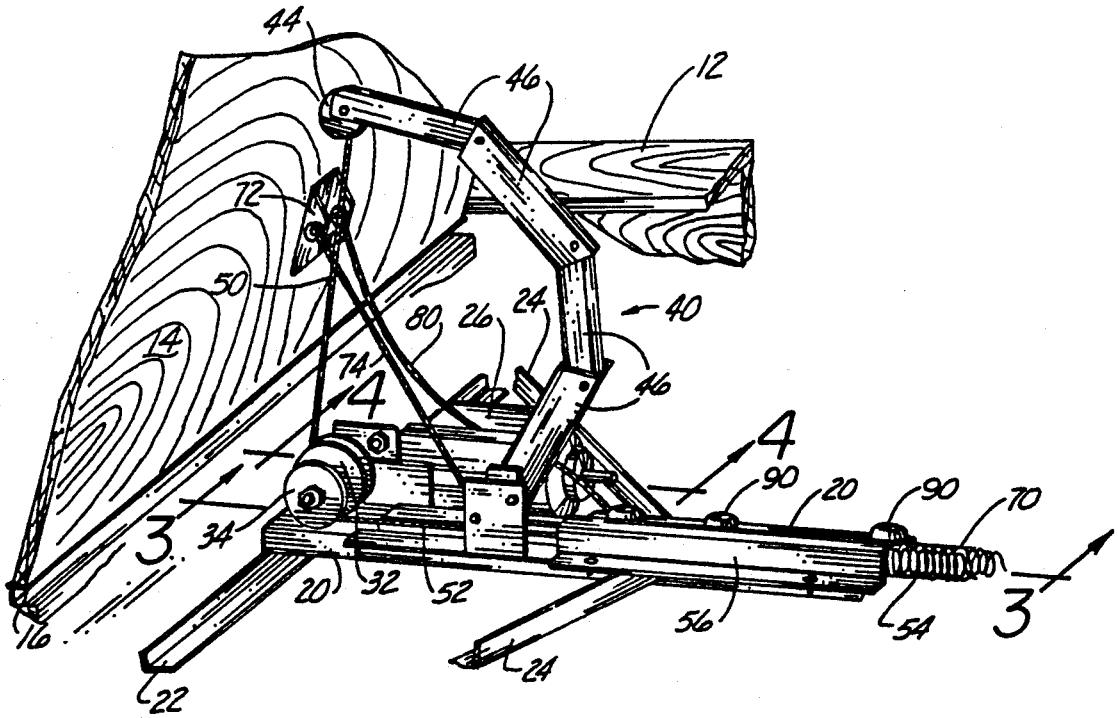
FIG. 2 is a partial perspective view showing the work board in a raised position and showing the operating mechanism for raising and lowering the work board.
Figure 4:
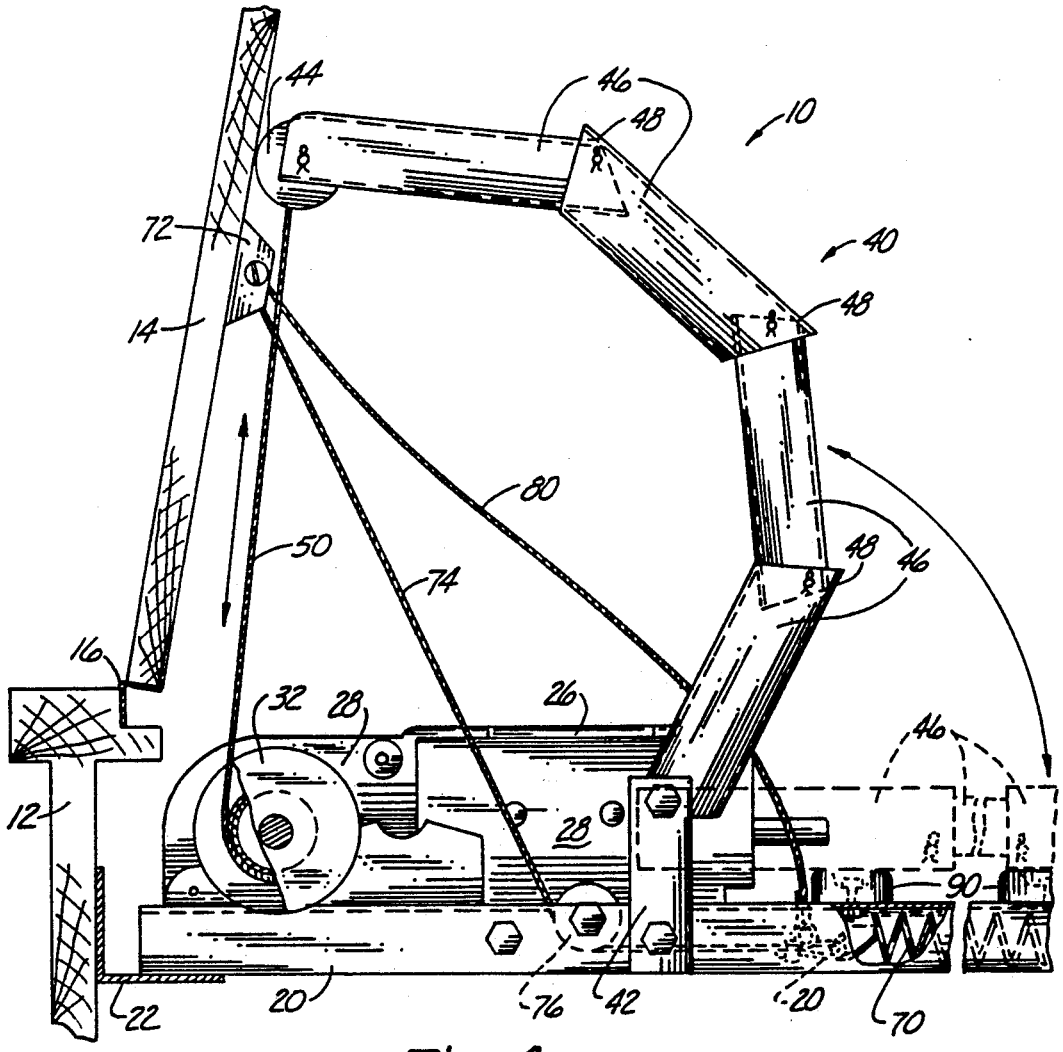
FIG. 4 is an enlarged sectional view taken along line 4—4 of FIG. 2.

Referring now to the drawings, wherein like reference numerals designate identical or corresponding parts throughout the several views, FIG. 1 shows the variable slant work board (10) of the present invention incorporated into a conventional desk (12). As best shown in FIGS. 2 and 4, the work surface (14) is pivotally attached to the desk (12) by a hinge (16). The operating mechanism for raising and lowering the work surface (14) is supported on a base or frame (20) which rests on angle brackets (22) and is stabilized by diagonal braces (24). An electric motor (26) is attached to the base (20) by a mounting bracket (28). The output shaft (29) of the motor (26) is journalled into a bearing (30) to simultaneously drive an arm winch (32) and a limit switch winch (34) when the control switch (36) is activated.

A segmented arm (40) is pivotally attached at one end to the base (20) through an arm support bracket (42). The free end of the segmented arm (40) carries a roller (44) that contacts the lower surface of the work board (14). The segmented arm (40) includes four arm sections (46) pivotally attached in end-to-end relationship. Each of the arm sections (46) has a pivot stop (48) that restricts the upward pivotal movement to a predetermined angular range as illustrated in FIG. 4. An arm cable (50) interconnects the free end of the segmented arm (40) and the arm winch (32).

Figure 3:
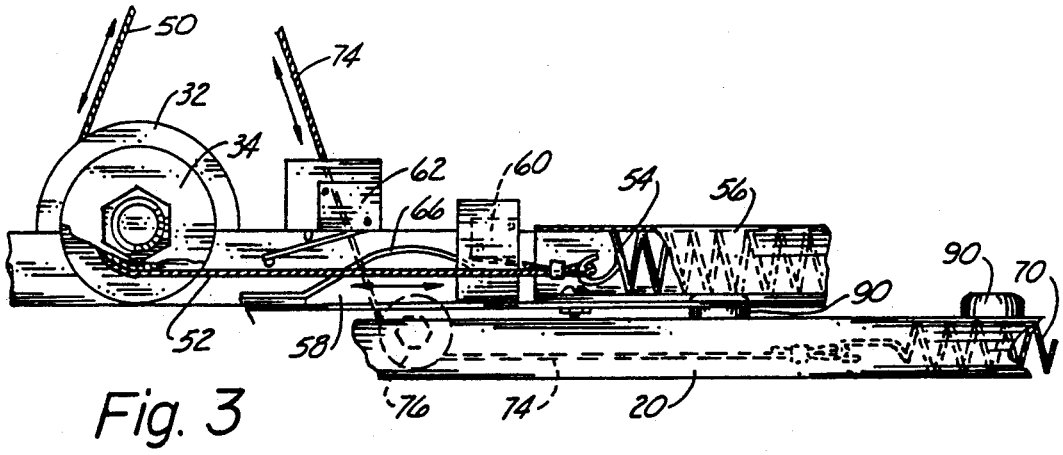
FIG. 3 is an enlarged sectional view taken along line 3—3 of FIG. 2.

As most clearly shown in FIG. 3, the limit switch winch (34) is connected by the limit switch cable (52) and limit switch spring (54) to cover (56), which in turn is connected to the base (20). A guide member (58) extends from the cover (56) toward the limit switch winch (34) and supports limit switches (60, 62). A sled (64) with limit switch actuator (66) is attached to cable (52) and moves with the cable (52) when the limit switch winch (34) is activated.

Referring to FIGS. 3 and 4, it can be seen that the work board (14) is biased toward the lowered horizontal position by an expansion spring (70) disposed in and attached to the base (20). The spring (70) is attached to a bracket (72) on the work board (14) by a spring cable (74) that passes under a pulley (76) attached to the base (20).

Figure 5:
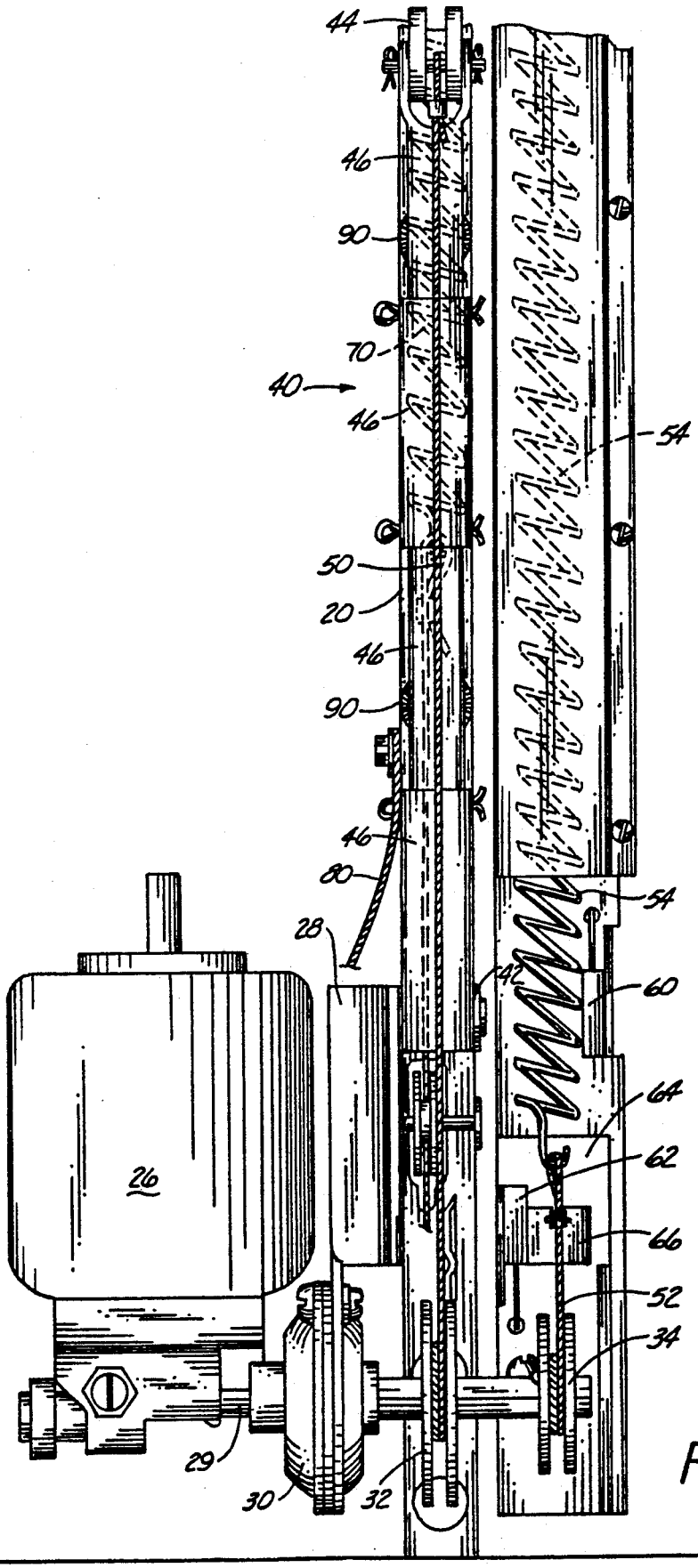
FIG. 5 is a top plan view showing the segmented arm in the lowered position.

The variable slant work board (10) is operated by selective activation of the control switch (36) by the user to position the work surface (14) in any of a number of positions between the lowered horizontal position and the raised vertical position. When starting from the horizontal position, the limit switch spring (54) is in the extended position (FIG. 5) and provides an initial assist to raise the segmented arm (40). As the arm winch (32) takes up cable (50) the limit switch winch (34) pays out cable (52). Thus, as the segmented arm (40) is raised to lift the board (14) toward the vertical position, the actuator (66) approaches contact with the limit switch (60) to deactivate the motor (26). Also, a safety cable (80) prevents the board (14) from pivoting beyond the vertical position. Further, as the board (14) approaches the vertical position, the expansion spring (70) extends and exerts a progressively increasing downward force on the board (14).

When the motor (26) is reversed to lower the board (14) toward the horizontal position, the limit switch spring (54) extends and maintains the arm cable (50) in tension, while the expansion spring (70) simultaneously retracts and biases the board (14) downwardly. As the board (14) approaches the horizontal position, the actuator (66) approaches contact with the limit switch (62) to deactivate the motor (26). When the segmented arm (40) is fully lowered to rest on the cushions (90), the work board (14) is in the fully lowered horizontal position flush with the surface of the desk (12).

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than a specifically described.

I claim:

1. A variable slant work board, comprising:

a base;

a work board including an upper work surface, a lower contact surface, and a lower edge, the lower edge of said work board being pivotally attached to the base;

means for applying an upward force on the lower contact surface to pivot the work board upwardly toward a raised vertical position; including: a winch mounted on said base below the work board; a multi-segmented arm having one end pivotally attached to said base, and a free end provided with a roller disposed to contact the lower surface of the work board; a first cable extending between said free end of the multi-segmented arm and the winch; means for actuating said winch wherein, the actuation of the winch will cause the free end of the multi-segmented arm to engage the lower contact surface to pivot the work board upwardly towards a raised vertical position; and, a second cable attached on one end to both the winch and attached on the other end to an assist spring connected to the base for providing an initial assist in raising the multi-segmented arm; and means for biasing the work board downwardly toward a lowered horizontal position including: a third cable attached on one end to the lower surface of the work board and connected on the other end to an expansion spring attached to said base.

2. The work board of claim 1 wherein the winch is powered by an electric motor attached to the base below the work board.

3. The work board of claim 1 wherein the segmented arm includes a plurality of arm sections pivotally connected in end-to-end relationship, each arm section including a pivot stop disposed such that upward pivotal movement is restricted to a predetermined angular range.

4. The work board of claim 1 wherein the expansion spring is horizontally disposed below the work board, and wherein said spring cable is disposed to pass under a pulley mounted on the base in horizontal alignment with the expansion spring.

5. The work board of claim 1 wherein the electric motor is selectively activated by a switch mounted on the front of the base below the work board.

* * * * *